US008474079B1

(12) United States Patent
Gangitano

(10) Patent No.: US 8,474,079 B1
(45) Date of Patent: Jul. 2, 2013

(54) BODY SUPPORT PILLOW ASSEMBLY

(76) Inventor: Frances Gangitano, Colonia, NJ (US)

( * ) Notice: Subject to any disclaimer, the term of this patent is extended or adjusted under 35 U.S.C. 154(b) by 0 days.

(21) Appl. No.: 13/405,352

(22) Filed: Feb. 26, 2012

(51) Int. Cl.
*A47C 20/00* (2006.01)
*A47C 16/00* (2006.01)

(52) U.S. Cl.
USPC ..... 5/731; 5/732; 5/733; 5/652; 5/632; 5/421

(58) Field of Classification Search
USPC ..... 5/421, 652, 655, 646, 647, 630, 632, 5/732–735, 902
See application file for complete search history.

(56) References Cited

U.S. PATENT DOCUMENTS

| | | | | |
|---|---|---|---|---|
| 4,858,259 | A | 8/1989 | Simmons et al. | |
| 4,907,306 | A * | 3/1990 | Nakaji | 5/632 |
| 5,224,226 | A * | 7/1993 | Groenewald | 5/733 |
| 5,432,967 | A | 7/1995 | Raftery | |
| 5,440,770 | A * | 8/1995 | Nichols | 5/655 |
| 5,528,783 | A | 6/1996 | Kunz et al. | |
| 5,545,199 | A | 8/1996 | Hudson | |
| 5,916,088 | A | 6/1999 | Gueli | |
| 5,948,303 | A * | 9/1999 | Larson | 219/486 |
| 5,970,545 | A | 10/1999 | Garman et al. | |
| 6,067,678 | A * | 5/2000 | Trevino | 5/628 |
| 7,467,431 | B2 | 12/2008 | Weedling et al. | |
| 7,513,002 | B2 | 4/2009 | Best | |
| 8,074,312 | B2 * | 12/2011 | Tullous | 5/655 |
| 8,291,534 | B2 * | 10/2012 | Karlson | 5/646 |
| 2001/0052153 | A1 * | 12/2001 | Schwartz et al. | 5/905 |
| 2009/0222991 | A1 | 9/2009 | Davis, III | |

* cited by examiner

*Primary Examiner* — Michael Trettel

(57) ABSTRACT

A body support pillow assembly is provided for holding a person in an upright position facilitating eating, performing certain tasks, or inhibiting acid reflux. The assembly includes a wedge having a top surface and a bottom surface. A pair of opposed side walls is coupled to the wedge and each of the side walls extends upwardly from a perimeter edge of the upper surface of the wedge. A pair of opposed arms grooves is provided. Each arm groove is positioned in a respective one of the side walls. A neck support is coupled to and extends between upper ends of the side walls.

18 Claims, 3 Drawing Sheets

FIG. 4
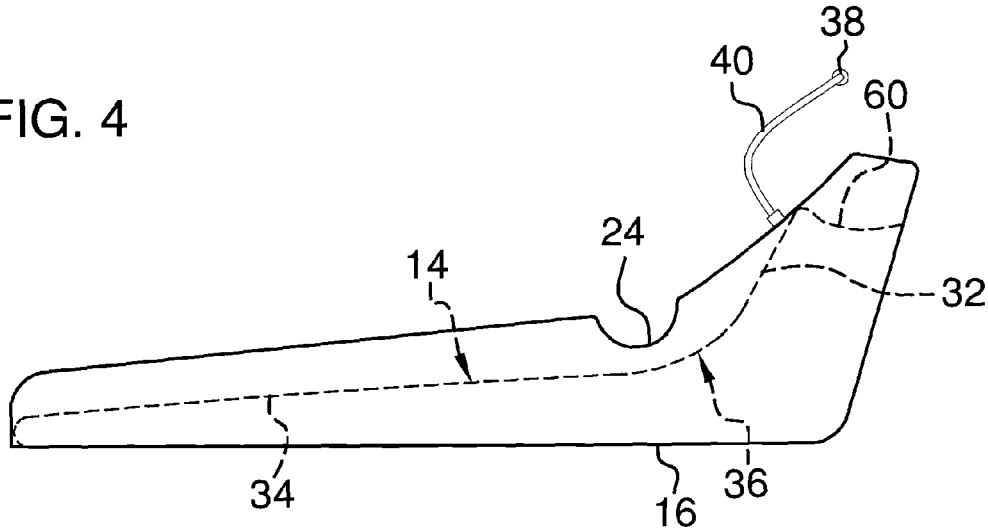
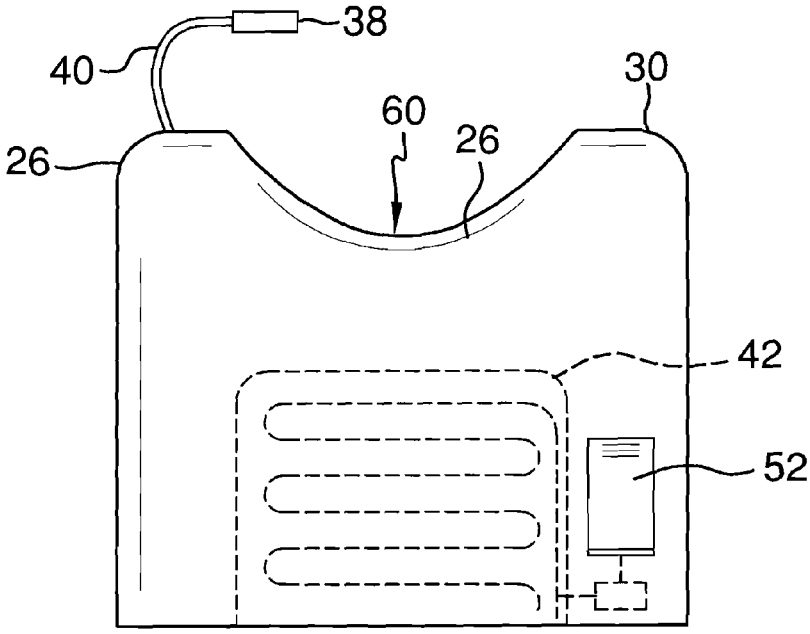
FIG. 5

BODY SUPPORT PILLOW ASSEMBLY

BACKGROUND OF THE DISCLOSURE

Field of the Disclosure

The disclosure relates to body support devices and more particularly pertains to a new body support device for holding a person in an upright position facilitating eating or inhibiting acid reflux.

SUMMARY OF THE DISCLOSURE

An embodiment of the disclosure meets the needs presented above by generally comprising a wedge having a top surface and a bottom surface. A pair of opposed side walls is coupled to the wedge and each of the side walls extends upwardly from a perimeter edge of the upper surface of the wedge. A pair of opposed arms grooves is provided. Each arm groove is positioned in a respective one of the side walls. A neck support is coupled to and extends between upper ends of the side walls.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein:

FIG. 4 is a side view of an embodiment of the disclosure.

FIG. 5 is a back view of an embodiment of the disclosure.

DESCRIPTION OF THE PREFERRED EMBODIMENT

Figure 1:
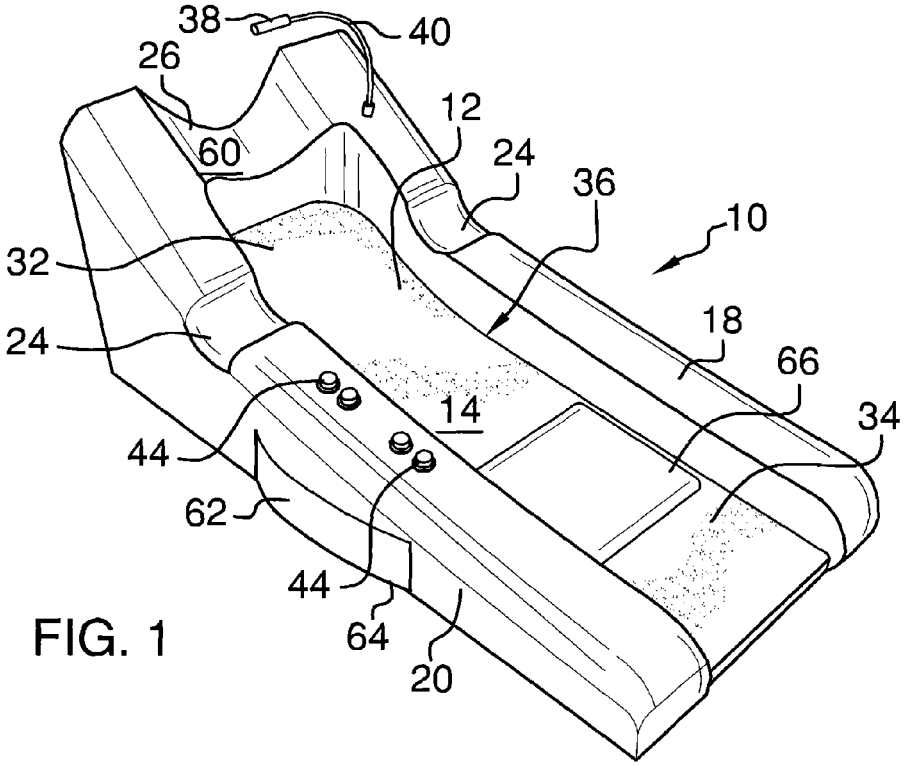
FIG. 1 is a top front side perspective view of a body support pillow assembly according to an embodiment of the disclosure.
Figure 2:
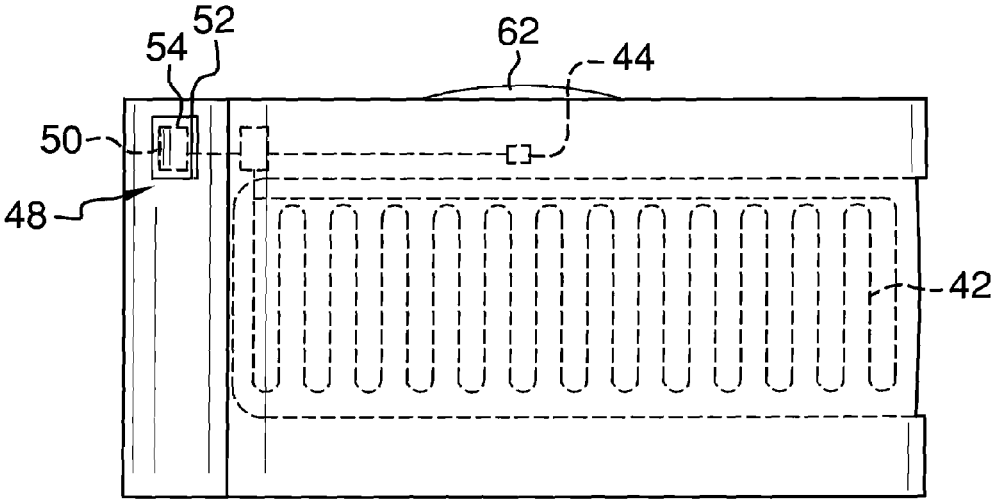
FIG. 2 is a bottom view of an embodiment of the disclosure.
Figure 3:
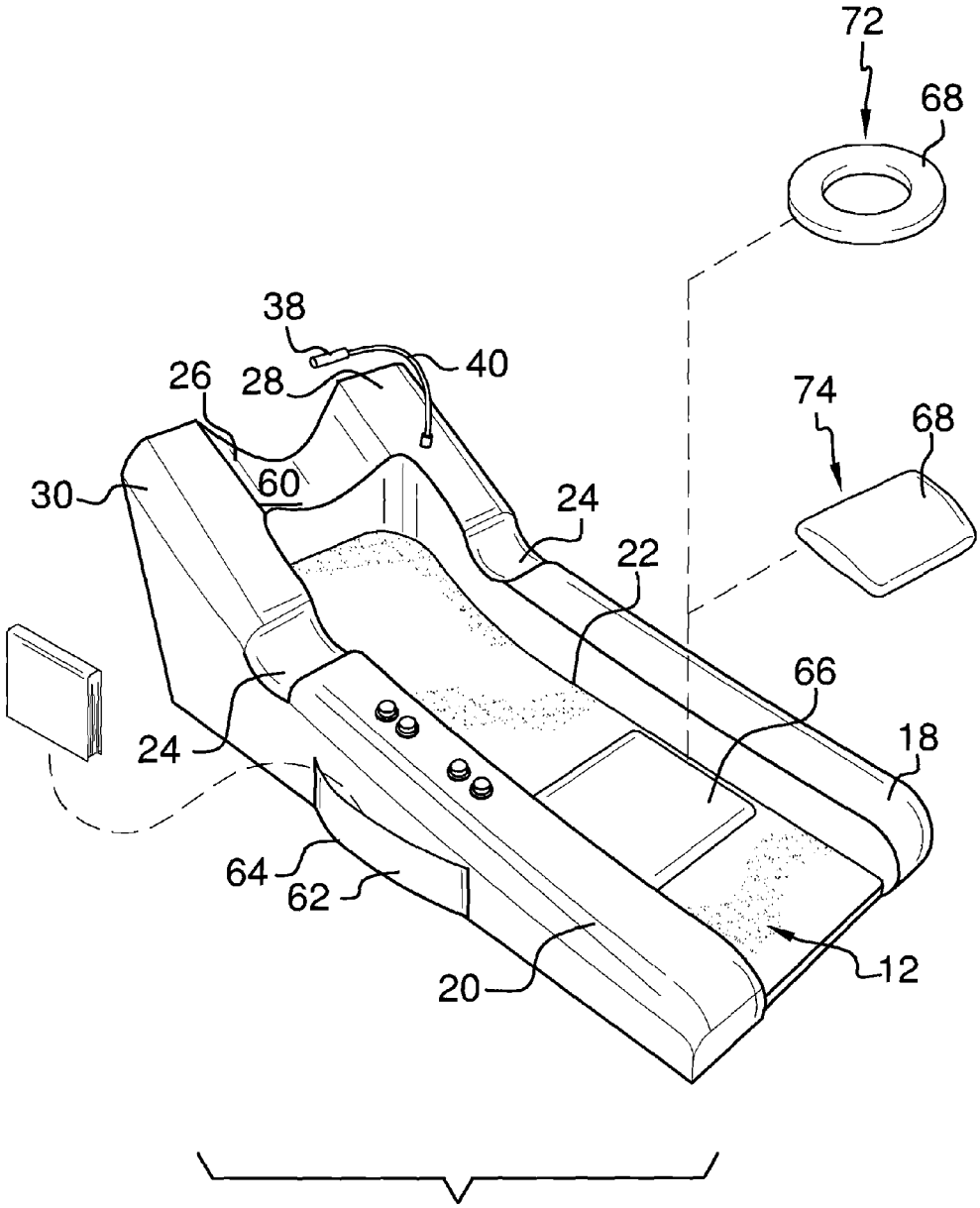
FIG. 3 is a top front side perspective view of an embodiment of the disclosure.

With reference now to the drawings, and in particular to FIGS. 1 through 5 thereof, a new body support device embodying the principles and concepts of an embodiment of the disclosure and generally designated by the reference numeral 10 will be described.

As best illustrated in FIGS. 1 through 5, the body support pillow assembly 10 generally comprises a wedge 12 that may be constructed of a solid material, compressible material, or be inflatable provided the wedge 12 is configured to support a human being positioned on the wedge 12. The wedge 12 has a top surface 14 and a bottom surface 16. A pair of opposed side walls 18,20 is coupled to the wedge 12. Each of the side walls 18,20 extends upwardly from a perimeter edge 22 of the upper surface 14 of the wedge 12. A pair of opposed arms grooves 24 is provided and each arm groove 24 is positioned in a respective one of the side walls 18,20. A neck support 26 is coupled to and extends between upper ends 28,30 of the side walls 18,20. An upper surface 60 of the neck support 26 may be arcuate to provide even support to a neck of a user positioned on the wedge 12.

An upper portion 32 of the upper surface 14 of the wedge 12 is inclined relative to a flat lower portion 34 of the upper surface 14 of the wedge 12. A transitional area 36 may be a straight junction or curved.

A light 38 may be coupled to and extend from a first one of the side walls 18. A positionable or segmented arm 40 extends between the light 38 and the side wall 18. Thus, the light 38 may be directed in a desired position by adjusting the positionable arm 40. A heating coil 42 may be coupled to the wedge 12 to provide warmth. The heating coil 42 warms the upper surface 14 of the wedge 12 facilitated by being positioned proximate the upper surface 14 of the wedge 12. At least one control 44 is coupled to one of the side walls 20. The control 44 is operationally coupled to the heating coil 42 whereby a temperature of the heating coil 42 or distinctly controlled segments of the heating coil 42 is adjustable. A power source 48 such as a battery 50 is operationally coupled to the heating coil 42 and the control 44. The battery 50 may be positioned in a battery compartment 52 having an open side 54 on the bottom surface 16 of the wedge 12.

A side pocket 62 may be coupled to either one of the side walls 18,20. The side pocket 62 may be coupled to the side wall 18 below control 44 with a bottom edge 64 of the side pocket 62 being coplanar with the bottom surface 16 of the wedge 12. The side pocket 62 may be configured for holding various items including a book.

An insert pocket 66 is coupled to the upper surface 14 of the wedge 12. An insert 68 is positionable in the insert pocket 66. The insert 68 may be a gel filled pad 70 or other pad structured to provide direct support to a selectable area of the user's back. The insert 68 may be provided in various shapes and configurations including annular 72 and rectangular 74 to provide customizable positioning of the insert 68 relative to the user positioned on the wedge 12.

Straps 76 may extend from the opposed side walls 18 and 20. The straps 76 may be used to secure the assembly 10 to a bed to prevent unintended displacement of the assembly 10 as a person uses the assembly 10. Additionally, a pillow 78 may be included. The pillow 78 may be coupled to the neck support 26 for additional cushioning. The pillow 78 may be formed of resilient foam or comprise an envelope holding a plurality of cushioning materials such as foam pellets, down, or any other conventional pillow material. The pillow 78 may be fixedly coupled or removably coupled to the neck support 26.

In use, the assembly 10 provides support in an inclined sitting up position from the wedge 12 as well as lateral support from the arms 18,20. This holds a person in an inclined position providing additional comfort and security for feeble persons while eating, reading, or performing other tasks which may be difficult to perform in a prone position. The light 38 may be positioned to illuminate a desired area. The heating coil 42 and insert 68 may be used as desired to enhance comfort by warming muscles or preventing direct contact with sores or other sensitive areas of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A body support assembly comprising:

a wedge having a top surface and a bottom surface;

a pair of opposed side walls coupled to said wedge, each of said side walls extending upwardly from a perimeter edge of said upper surface of said wedge;

a pair of opposed arms grooves, each said arm groove being positioned in an respective one of said side walls; and a neck support coupled to and extending between upper ends of said side walls.

2. The assembly of claim 1, further including an upper portion of said upper surface of said wedge being inclined relative to a lower portion of said upper surface of said wedge.

3. The assembly of claim 1, further including a light coupled to and extending from a first one of said side walls.

4. The assembly of claim 3, further including a positionable arm extending between said light and said one of said side walls whereby said light is directed in a desired position by adjusting said positionable arm.

5. The assembly of claim 1, further including a heating coil coupled to said wedge, said heating coil warming said upper surface of said wedge.

6. The assembly of claim 5, further including said heating coil being positioned proximate said upper surface of said wedge.

7. The assembly of claim 5, further including a control coupled to one of said side walls, said control being operationally coupled to said heating coil whereby a temperature of said heating coil is adjustable.

8. The assembly of claim 7, further including a power source operationally coupled to said heating coil and said control.

9. The assembly of claim 8, further including said power source being a battery.

10. The assembly of claim 1, further including an upper surface of said neck support being arcuate.

11. The assembly of claim 1, further including a side pocket coupled to one of said side walls.

12. The assembly of claim 1, further comprising:

an insert pocket coupled to said upper surface of said wedge; and an insert positionable in said insert pocket.

13. The assembly of claim 12, further including said insert being a gel filled pad.

14. The assembly of claim 13, further including said pad being annular.

15. The assembly of claim 13, further including said pad being rectangular.

16. A body support assembly comprising:

a wedge having a top surface and a bottom surface;

a pair of opposed side walls coupled to said wedge, each of said side walls extending upwardly from a perimeter edge of said upper surface of said wedge;

a pair of opposed arms grooves, each said arm groove being positioned in an respective one of said side walls;

a neck support coupled to and extending between upper ends of said side walls;

an upper portion of said upper surface of said wedge being inclined relative to a lower portion of said upper surface of said wedge;

a light coupled to and extending from a first one of said side walls;

a positionable arm extending between said light and said one of said side walls whereby said light is directed in a desired position by adjusting said positionable arm;

a heating coil coupled to said wedge, said heating coil warming said upper surface of said wedge, said heating coil being positioned proximate said upper surface of said wedge;

a control coupled to one of said side walls, said control being operationally coupled to said heating coil whereby a temperature of said heating coil is adjustable;

a power source operationally coupled to said heating coil and said control, said power source being a battery;

an upper surface of said neck support being arcuate;

a side pocket coupled to one of said side walls;

an insert pocket coupled to said upper surface of said wedge; and an insert positionable in said insert pocket, said insert being a gel filled pad.

17. The assembly of claim 16, further including said pad being annular.

18. The assembly of claim 16, further including said pad being rectangular.

* * * * *